US005302279A

United States Patent [19]

Degnan et al.

[11] Patent Number: 5,302,279

[45] Date of Patent: Apr. 12, 1994

[54] LUBRICANT PRODUCTION BY HYDROISOMERIZATION OF SOLVENT EXTRACTED FEEDSTOCKS

[75] Inventors: Thomas F. Degnan, Moorestown; Quang N. Le, Cherry Hill, both of N.J.

[73] Assignee: Mobil Oil Corporation, Fairfax, Va.

[21] Appl. No.: 996,386

[22] Filed: Dec. 23, 1992

[51] Int. Cl.[5] ..... C10G 1/04; C10G 35/06

[52] U.S. Cl. ..... 208/87; 208/89; 208/135; 208/137; 208/138; 208/141

[58] Field of Search ..... 208/33, 96, 114, 143, 208/27, 18, 87, 58, 27, 59, 111, 120, 124, 135, 138; 209/113, 119

[56] References Cited

U.S. PATENT DOCUMENTS

| | | | |
|---|---|---|---|
| 4,181,598 | 1/1980 | Gillespie et al. | 208/58 |
| 4,419,220 | 12/1983 | LaPierre et al. | 208/111 |
| 4,428,819 | 1/1984 | Shu et al. | 208/46 |
| 4,518,485 | 5/1985 | LaPierre et al. | 208/89 |
| 4,911,821 | 3/1990 | Katzer et al. | 208/27 |
| 4,919,788 | 4/1990 | Chen et al. | 208/59 |
| 4,975,177 | 12/1990 | Garwood et al. | 208/27 |
| 5,110,445 | 5/1992 | Chen et al. | 208/96 |

FOREIGN PATENT DOCUMENTS

464547A1 1/1992 European Pat. Off. .

OTHER PUBLICATIONS

Zeolite Synthesis, Ocelli Mario L. and Rohson, Harry E. (editors), ACS Symposium Series, pp. 393–403, American Chemical Society, Wash., DC 1989.

*Primary Examiner*—R. Bruce Breneman
*Assistant Examiner*—Bekir L. Yildirim
*Attorney, Agent, or Firm*—Alexander J. McKillop; Dennis P. Santini; Laurence P. Hobbes

[57] ABSTRACT

Hydrocarbon lubricants having a high viscosity index (V.I.) and low pour point are produced by hydroisomerizing, over zeolite beta, a waxy lube feed such as a waxy vacuum gas oil whose aromatic components are removed by extraction, e.g. with furfural. The zeolite beta catalyst comprises noble metal, e.g., Pt, and a low acidity zeolite beta, e.g., framework boron-containing zeolite beta.

20 Claims, 1 Drawing Sheet

LUBRICANT PRODUCTION BY HYDROISOMERIZATION OF SOLVENT EXTRACTED FEEDSTOCKS

FIELD OF THE INVENTION

The present invention relates to a process for the production of lubricants and more particularly, to a process for the production of hydrocarbon lubricants of high viscosity index.

BACKGROUND OF THE INVENTION

Mineral oil lubricants are derived from various crude oil stocks by a variety of refining processes which are directed towards obtaining a lubricant base stock of suitable boiling point, viscosity, viscosity index (VI) and other characteristics. Generally, the base stock will be produced from the crude oil by distillation of the crude in atmospheric and vacuum distillation towers, followed by the separation of undesirable aromatic components and finally, by dewaxing and various finishing steps. Because aromatic components lead to high viscosity, poor viscosity indices and poor oxidative stability, the use of asphaltic type crudes is not preferred as the yield of acceptable lube stocks will be extremely low after the large quantities of aromatic components contained in such crudes have been separated out; paraffinic crude stocks will therefore be preferred but aromatic separation procedures will still be necessary in order to remove undesirable aromatic components. In the case of the lubricant distillate fractions, generally referred to as the neutrals, e.g. heavy neutral, light neutral, etc., the aromatics will be extracted by solvent extraction using a solvent such as phenol, furfural or N-methylpyrrolidone (NMP) or another material which is selective for the extraction of the aromatic components. If the lube stock is a residual lube stock, the asphaltenes will first be removed in a propane deasphalting step followed by solvent extraction of residual aromatics to produce a lube generally referred to as bright stock. In either case, however, a dewaxing step is normally necessary in order for the lubricant to have a satisfactorily low pour point and cloud point, so that it will not solidify or precipitate the less soluble paraffinic components under the influence of low temperatures.

A number of dewaxing processes are known in the petroleum refining industry and of these, solvent dewaxing with solvents such as methylethylketone (MEK) and liquid propane, has been the one which has achieved the widest use in the industry. Recently, however, proposals have been made for using catalytic dewaxing processes for the production of lubricating oil stocks and these processes possess a number of advantages over the conventional solvent dewaxing procedures. The catalytic dewaxing processes which have been proposed are generally similar to those which have been proposed for dewaxing the middle distillate fractions such as heating oils, jet fuels and kerosenes, of which a number have been disclosed in the literature, for example, in Oil and Gas Journal, Jan. 6, 1975, pp. 69–73 and U.S. Pat. Nos. RE 28,398, 3,956,102 and 4,100,056. Generally, these processes operate by selectively cracking the longer chain end paraffins to produce lower molecular weight products which may then be removed by distillation from the higher boiling lube stock. The catalysts which have been proposed for this purpose have usually been zeolites which have a pore size which admits the straight chain, waxy n-paraffins either alone or with only slightly branched chain paraffins but which exclude more highly branched materials and cycloaliphatics. Zeolites such as ZSM-5, ZSM-11, ZSM-12, ZSM-22, ZSM-23, ZSM-35 and ZSM-38 have been proposed for this purpose in dewaxing processes, as described in U.S. Pat. Nos. 3,894,938, 4,176,050, 4,181,598, 4,222,855, 4,229,282 and 4,247,388. A dewaxing process employing synthetic offretite is described in U.S. Pat. No. 4,259,174.

Although the catalytic dewaxing processes are commercially attractive because they do not produce quantities of solid paraffin wax which presently is regarded as an undesirable, low value product, they do have certain disadvantages and because of this, certain proposals have been made for combining the catalytic dewaxing processes with other processes in order to produce lube stocks of satisfactory properties. For example, U.S. Pat. No. 4,181,598 discloses a method for producing a high quality lube base stock by subjecting a waxy fraction to solvent refining, followed by catalytic dewaxing over ZSM-5 with subsequent hydrotreatment of the product. U.S. Pat. No. 4,428,819 discloses a process for improving the quality of catalytically dewaxed lube stocks by subjecting the catalytically dewaxed oil to a hydroisomerization process which removes residual quantities of petrolatum wax which contribute to poor performance in the Overnight Cloud Point test (ASTM D2500-66). This process is intended to overcome one disadvantage of the intermediate pore dewaxing catalysts such as ZSM-5 which is that the normal paraffins are cracked much faster than the slightly branched chain paraffins and cycloparaffins so that, although a satisfactory pour point is attained (because the straight chain paraffins are removed) residual quantities of branched chain paraffins and cycloparaffins may be left in the oil, to contribute to a poor performance in the Overnight Cloud Point test when the oil is subjected to a relatively low temperature for an extended period of time. During this time, the petrolatum wax which is made up of the less soluble slightly branched chain paraffins and cycloparaffins, nucleates and grows into wax crystals of a sufficient size to produce a perceptible haze. Although it would be possible to remove the petrolatum wax by operating the dewaxing process at a higher conversion so that these components were removed together with the straight chain paraffins, the yield loss which would result, has generally been considered unacceptable As mentioned above, the conventional catalytic dewaxing processes using intermediate pore size zeolites such as ZSM-5 operate by selectively cracking the waxy components of the feed. This results in a loss in yield since the components which are in the desired boiling range undergo a bulk conversion to lower boiling fractions which, although they may be useful in other products, must be removed from the lube stock. A notable advance in the processing of lube stocks is described in U.S. Pat. Nos. 4,419,220 and 4,518,485, in which the waxy components of the feed, comprising straight chain and slightly branched chain paraffins, are removed by isomerization over a catalyst based on zeolite beta.

During the isomerization, the waxy components are converted to relatively less waxy isoparaffins and at the same time, the slightly branched chain paraffins undergo isomerization to more highly branched aliphatics. A measure of cracking does take place during the operation so that not only is the pour point reduced by reason of the isomerization but, in addition, the heavy ends undergo some cracking or hydrocracking to form liquid range materials which contribute to a low viscosity product. The degree of cracking is, however, limited so as to maintain as much of the feedstock as possible in the desired boiling range. As mentioned above, this process uses a catalyst which is based on zeolite beta, together with a suitable hydrogenation-dehydrogenation component which is typically a base metal or a noble metal, usually of group VIA or VIIIA of the Periodic Table of the Elements (the periodic table used in this specification is the table approved by IUPAC), such as cobalt, molybdenum, nickel, tungsten, palladium or platinum. As described in U.S. Pat. No. 4,518,485, the isomerization dewaxing step may be preceded by a hydrotreating step in order to remove heteroatom-containing impurities, which may be separated in an interstage separation process similar to that employed in two-stage hydrotreating-hydrocracking processes.

The zeolite beta dewaxing process has significant advantages for dewaxing extremely waxy feeds, for example, Pacific and South-East Asian gas oils which may have upwards of 50 percent paraffins. Enhanced utilization of the properties of zeolite beta may, however, be secured by utilizing it in combination with other processing steps. For example, European Patent Application Publication No. 225,053 (corresponding to U.S. application Ser. No. 793,937, filed Nov. 1, 1985, now U.S. Pat. No. 5,179,103 and U.S. Pat. No. 4,919,788) utilizes an initial hydroisomerization step using a zeolite beta catalyst followed by a selective dewaxing over ZSM-5 or ZSM-23 or even solvent dewaxing to produce a product of high V.I. and low pour point. The initial hydroisomerization effectively removes waxy components from the back end of the feeds by isomerizing them to high V.I. isoparaffins and the subsequent selective dewaxing step preferentially removes front end waxes to obtain the target pour point. Extremely waxy stocks such as slack wax and deoiled wax are of particular utility in this process, as described in U.S. Pat. No. 4,975,177. Conventional high pressure hydroisomerization processes used in the production of very high V.I. lubes (120–145 V.I.) typically employ pressures over 1500 psig (about 10,440 kPa). See, for example, Developments in Lubrication PD19(2), 221–228 (Bull). Unlike these, the zeolite beta isomerization process operates well at low to moderate hydrogen pressures e.g. 300–1250 psig (about 2170–8720 kPa) and is therefore readily accommodated in existing low pressure refinery units e.g. Catalytic Hydrodesulfurization (CHD) units. In addition, the feed for the zeolite beta isomerization process may be obtained from various refinery streams including slack waxes and deoiled waxes as mentioned above as well as straight run gas oil (VGO) and deasphalted oil (DAO). The conventional high pressure process, however, usually employs wax feeds of specific character derived from aromatics extraction or hydrocracking of a crude prior to dewaxing.

Regardless of the nature of the feed, certain problems may arise. One is that a certain degree of cracking takes place during the isomerization process at the acidic sites on the zeolite beta catalyst. This cracking will cause dealkylation of some of the long chain alkyl substituted aromatic components so that cracking products including polycyclic aromatics within the lube boiling range but of extremely poor V.I. and oxidation stability are obtained. These components may adversely affect the properties of the final lube product. In addition, a disparity between the pour point (ASTM D-97 or equivalent method e.g. Autopour) and cloud point (ASTM D-2500–66) may develop, as described above as a result of certain waxes, primarily of a naphthenic character remaining in the oil after the isomerization-dewaxing step.

European Patent Application 0 464 547 discloses the preparation of high VI lubricants by treating a waxy feed which is hydrocracked to remove aromatic components followed by hydroisomerization over a low acidity zeolite beta catalyst, e.g. Pt/zeolite beta which contains boron as a framework component to give a low alpha value. The removal of aromatics in the first step permits use of lower hydroisomerization temperatures in the second step which limits 650° F.+conversion and enhances paraffin isomerization selectivity. However, it is necessary to further treat the hydroisomerized product by dewaxing, e.g., solvent dewaxing with methylethylketone.

SUMMARY OF THE INVENTION

We have now devised a process for producing a high viscosity index (VI) lubricant from a hydrocarbon feed of mineral oil content having a paraffin content of at least 30 wt %, a nitrogen content of at least 50 ppm, and an aromatics content of at least 10 wt % which comprises:

i) extracting said feed with a solvent which is selective for aromatics to provide an extracted feed containing greater than 40 wt % paraffins, less than 15 wt % aromatics, and less than 30 ppm nitrogen content, and ii) hydroisomerizing the extracted feed with a low acidity zeolite beta catalyst having an alpha value less than 15 and an inorganic oxide matrix to provide a lubricant having a viscosity index of at least 110.

The present invention is of particular advantage in that it permits the preparation of high VI lubricant from vacuum gas oils. Such feeds can include neutral gas oils, e.g., those having a boiling point range of 650 to 1250° F., preferably 750 to 1050° F. Waxy vacuum gas oils which are treated by the extracting step i) exhibit characteristics similar to those of a heavy neutral slack wax feedstock, but with reduced aromatics content.

DETAILED DESCRIPTION

Feedstock

Figure 1:
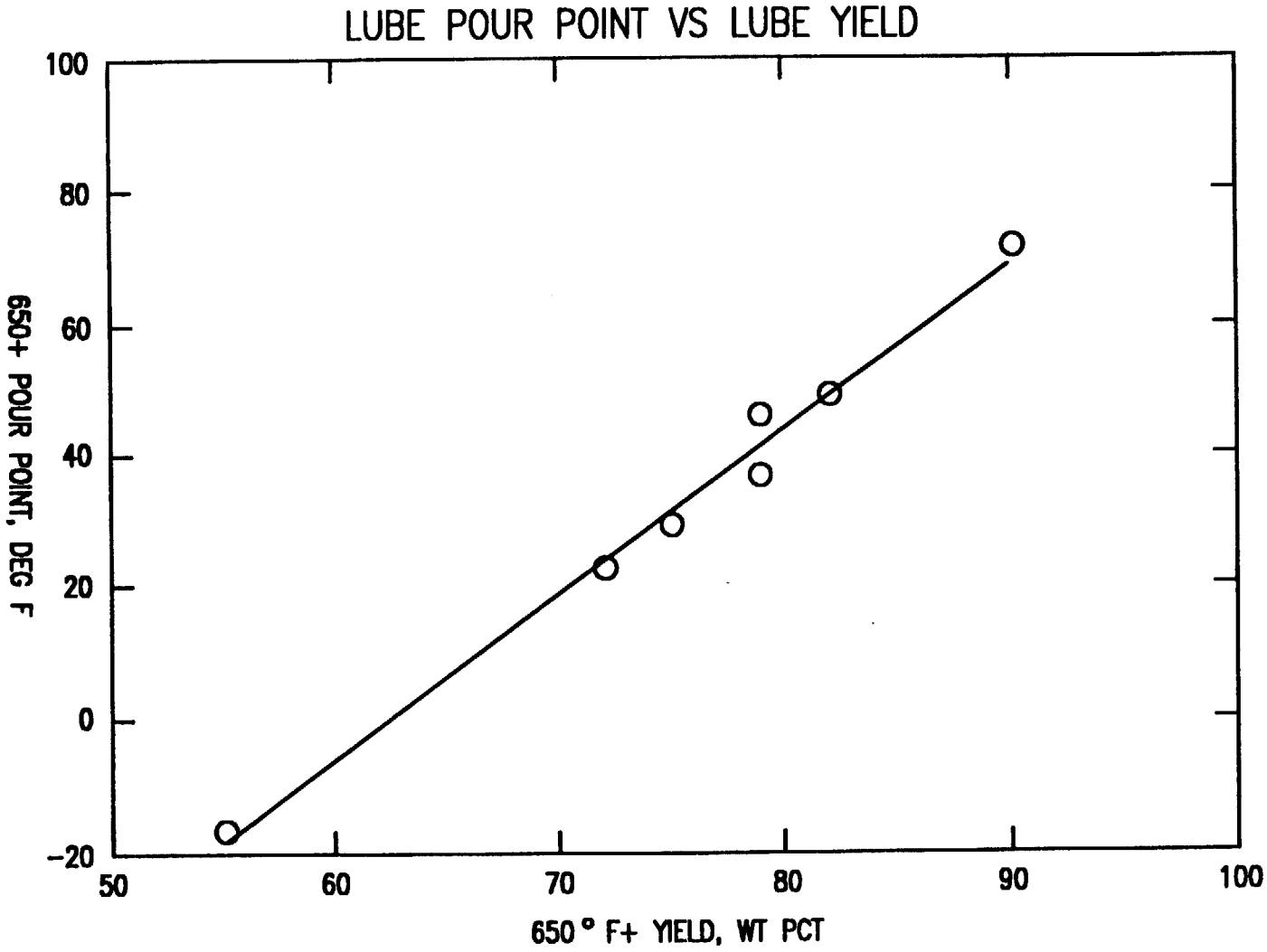
FIG. 1 is a plot of 650° F.+ lube yield (wt %) versus pour point (°F).

The feedstock for the present process may generally be characterized as a lube fraction prepared from a crude stock of suitable characteristics, e.g., by distillation in atmospheric and vacuum towers. Such feedstocks have a paraffin content of at least 30 wt %, preferably at least 45 wt %, a nitrogen content of at least 50 ppm, preferably at least 100 ppm, and an aromatics content of at least 10 wt %, preferably at least 15 wt %. Examples of such feedstocks include waxy gas oils, e.g., those having a boiling point range of 650 to 1250 F, preferably 750 to 1050° F. Lubricant distillate fractions, generally referred to as the neutrals, e.g. heavy neutral, light neutral, etc., contain aromatics which are extracted by solvent extraction using a solvent which is selective for the extraction of the aromatic components such as furfural, phenol or NMP. Other suitable feedstocks include fractionated visbreaker 650° F.+ fraction from waxy resids, unconverted 650° F.+bottoms from FCC units processing waxy VGO or atmospheric resids.

Generally, the neutral stocks will have a viscosity in the range of 100 to 750 SUS (20 to 160 cSt) at 40° C. (99° F.) and in the case of a bright stock, the viscosity will generally be in the range of 1000 to 3000 SUS (210 to about 600 cSt) at 99° C. (210° F).

The distillate (neutral) base stocks may generally be characterized as paraffinic in character, although they also contain naphthenes and aromatics and because of their paraffinic character, they are generally of fairly low viscosity and high viscosity index. The residual stocks such as bright stock will be more aromatic in character and for this reason will generally have higher viscosities and lower viscosity indices. In general, the aromatic content of the stock will be in the range of 10 to 70 weight percent, usually 15 to 60 weight percent with the residual stocks having the relatively higher aromatic contents, typically 20 to 70 weight percent, more commonly 30 to 60 weight percent and the distillate stocks having lower aromatic contents, for instance, 10 to 30 weight percent. Fractions in the gas oil boiling range (315° C.+(600° F.+)) with an end point usually below about 565° C. (about 1050° F.) are a convenient feed because they can generally be treated by the present process to produce high quality lubes.

A typical highly paraffinic gas oil fraction which may be treated by the present process to form a high quality, high VI lube is a 345°-540° C. (650°-1000° F.) Minas gas oil. Highly paraffinic feeds such as this will generally have a pour point of at least 40° C.; wax feeds such as slack wax will usually be solid at ambient conditions.

Other high boiling fractions which may be used as feeds for the present process include synthetic lubricant fractions derived, for example, from shale oil by synthesis from natural gas, coal or other carbon sources.

The waxy feed may be hydrotreated before the hydroisomerization in order to remove heteroatom containing impurities and to hydrogenate at least some of the aromatics which may be present to form naphthenes. Inorganic nitrogen and sulfur formed during the hydrotreating may be removed by a conventional separation prior to the catalytic dewaxing. Conventional hydrotreating catalysts and conditions are suitably used as described in U.S. Pat. No. 4,919,788.

Aromatics Extraction

In the first step of the present process, the feed is subjected to extraction with a solvent which dissolves aromatics such as phenol, furfural or N-methylpyrrolidone (NMP), with furfural being especially preferred. Such extraction can be carried out in an extraction unit under suitable extraction conditions. Suitable extraction units include rotating disc contactors and packed beds. Preferably, the extraction is carried out in a continuous extraction unit having multiple stages, e.g. 3 to 10 stages, using 100 to 300 vol % of solvent, at temperatures ranging from 125 to 275° F., preferably 125 to 225° F.

The extraction may be carried out in a conventional manner with solvent:oil ratios and extraction temperatures and durations adjusted to achieve the desired degree of aromatics removal which is itself determined by the characteristics desired in the final lube product, especially viscosity and oxidation stability.

The temperature and dosage of extraction solvent in this step is controlled to provide high VI products. Solvent:oil ratios of 1 to 5, preferably 1.5 to 2.5 (by weight), using furfural as the solvent, are typical. The extracts provide a useful source of sulfur-free or low-sulfur aromatic products which can be recovered from the solvent by conventional processing techniques such as distillation.

The solvent-free raffinate is thereafter passed to the isomerization step of the present invention.

Isomerization

In the second step of the present process, the raffinate of the first step is subjected to isomerization over zeolite beta, a large pore, siliceous zeolite catalyst. Although isomerization does not require hydrogen for stoichiometric balance, the presence of hydrogen is desirable in order to promote certain steps in the isomerization mechanism and also to maintain catalyst activity. Also, because the isomerization steps entail hydrogenation and dehydrogenation, the catalyst will contain a hydrogenation-dehydrogenation component in addition to the zeolite. A noble metal, preferably platinum or palladium, is used to provide hydrogenation-dehydrogenation functionality in the isomerization catalyst in order to promote the desired hydroisomerization reactions.

The isomerization can be carried out in the presence of hydrogen at a total pressure of at least 100 psig (740 kPa), preferably 200 to 1000 psig (1479 to 6991 kPa), at a temperature of 400 to B50° F. (204 to 454° C.), preferably 600 to 800° F. (316 to 427° C.). The conversion to 650° F.− (343° C.−) product is generally not more than 70 weight percent, preferably not more than 50 weight percent, based on the feed to the isomerization step.

The isomerization catalyst comprises a noble metal/zeolite beta catalyst containing boron as a framework component of the zeolite, having an alpha value not greater than 15, preferably not greater than 10, and more preferably not greater than 5, said alpha value being measured prior to incorporation of noble metal. The noble metal content ranges from 0.1 to 5 wt %, preferably from 0.5 to 2.0 weight percent based on the total weight of the catalyst.

Alpha value, or alpha number, of a zeolite is a measure of zeolite acidic functionality and is more fully described together with details of its measurement in U.S. Pat. No. 4,016,218, *J. Catalysis*, 6, pp. 278-287 (1966) and *J. Catalysis*, 61. pp. 390-396 (1980). The experimental conditions cited in the latter reference are used for characterizing the catalysts described herein. For present purposes, alpha is measured prior to incorporation of the hydrogenation/dehydrogenation component, of the zeolite, e.g., noble metal.

Noble metals, such as platinum and palladium, are employed in order to maximize the isomerization activity of the catalyst due to their strong hydrogenation function. Platinum may be incorporated into the catalyst by conventional techniques including ion exchange with complex platinum cations such as platinum tetraammine or by impregnation with solutions of soluble platinum compounds, for example, with platinum tetraammine salts such as platinum tetraamminechloride. The catalyst may be subjected to a final calcination under conventional conditions in order to convert the noble metal to the oxide form and to confer the required mechanical strength on the catalyst. Prior to use the catalyst may be subjected to presulfiding, by established techniques.

In the isomerization step, conditions are optimized for hydroisomerization of the paraffins in the raffinate. For this purpose a low acidity catalyst with high isomerization selectivity is employed, and for this purpose, a low acidity zeolite beta catalyst in which boron is present as a framework component of the zeolite beta has been found to give excellent results, particularly with respect to pour point and viscosity index. The boron is substituted for aluminum, preferably during synthesis and thereby eliminates the acidity which would be associated with the tetrahedral aluminum.

In addition to the hydrogenation component the hydroisomerization catalyst includes zeolite beta as an acidic (cracking) component. The pore structure of zeolite beta gives it highly desirable selective properties. Zeolite beta is a known zeolite which is described in U.S. Pat. Nos. 3,308,069 and U.S. Pat. No. RE 28,341, to which reference is made for further details of this zeolite, its preparation and properties. The preferred forms of zeolite beta for use in the present process are the high silica forms, having a silica:alumina ratio of at least 30:1 and it has been found that ratios of at least 50:1 or even higher, for example, 100:1, 250:1, 500:1, may be used to advantage because these forms of the zeolite are less active for cracking than the less highly siliceous forms so that the desired isomerization reactions are favored at the expense of cracking reactions which tend to effect a bulk conversion of the feed, forming cracked products which are outside the desired boiling range for lube components. Steamed zeolite beta with a higher silica:alumina ratio (framework) than the synthesized form of the zeolite is preferred. Suitable catalysts of this type used in the present process are described in U.S. Pat. Nos. 4,419,220 and 4,518,485 and EP 225,053, to which reference is made for a more detailed description of these zeolite beta based catalysts. As mentioned in the two patents, the silica:alumina ratios referred to in this specification are the structural or framework ratios and the zeolite, whatever its type, may be incorporated into a matrix material such as clay, silica or a metal oxide such as alumina or silica alumina.

Zeolite beta is the preferred support since this zeolite has been shown to possess outstanding activity for paraffin isomerization, as disclosed in U.S. Pat. No. 4,419,220, even in the presence of aromatics. The low acidity forms of zeolite beta may be obtained by synthesis of a highly siliceous form of the zeolite, e.g., with a silica-alumina ratio above 50:1, or, more readily, by steaming zeolites of lower silica-alumina ratio to the requisite acidity level. Another method is by replacement of a portion of the framework aluminum of the zeolite with another trivalent element such as boron which results in a lower intrinsic level of acid activity in the zeolite. The preferred zeolites of this type are those which contain framework boron, and normally at least 0.1 weight percent, preferably at least 0.5 weight percent, of framework boron is preferred in the zeolite. In zeolites of this type, the framework consists principally of silicon tetrahedrally coordinated and interconnected with oxygen bridges. A minor amount of a trivalent element (alumina in the case of aluminosilicate zeolite beta) is usually also coordinated and forms part of the framework. The zeolite also contains material in the pores of the structure although these do not form part of the framework constituting the characteristic structure of the zeolite. The term "framework" boron is used here to distinguish between material in the framework of the zeolite which is evidenced by contributing ion exchange capacity to the zeolite, from material which is present in the pores and which has no effect on the total ion exchange capacity of the zeolite.

Methods for preparing high silica content zeolites containing framework boron are known and are described, for example, in U.S. Pat. Nos. 4,269,813 and 4,672,049, incorporated herein by reference in their entireties. As noted therein, the amount of boron contained in the zeolite may be varied by incorporating different amounts of borate ion in the zeolite forming solution, e.g., by the use of varying amounts of boric acid relative to the forces of silica and alumina. Reference is made to these disclosures for a description of the methods by which these zeolites may be made.

The zeolite framework will normally include some alumina and the silica:alumina ratio will usually be at least 30:1, in the as-synthesized conditions of the zeolite. A preferred zeolite beta catalyst is made by steaming an initial boron-containing zeolite containing at least 1 weight percent boron (as $B_2O_3$) to result in an ultimate alpha value no greater than about 10 and preferably no greater than 5.

The steaming conditions should be adjusted in order to attain the desired alpha value in the final catalyst and typically utilize atmospheres of 100 percent steam, at temperatures of from 800 to 1100° F. (427 to 595° C.). Normally, the steaming will be carried out for about 12 to 48 hours, typically about 24 hours, in order to obtain the desired reduction in acidity. The use of steaming to reduce the acid activity of the zeolite has been found to be especially advantageous, giving results which are not achieved by the use of a zeolite which has the same acidity in its as-synthesized condition. It is believed that these results may be attributable to the presence of trivalent metals removed from the framework during the steaming operation which enhance the functioning of the zeolite in a manner which is not fully understood.

The zeolite will usually be composited with a matrix material to form the finished catalyst and for this purpose conventional non-acidic matrix materials such as alumina, silica-alumina and silica are suitable with preference given to silica as a non-acidic binder, although non-acidic aluminas such as alpha boehmite (alpha alumina monohydrate) may also be used, provided that they do not confer any substantial degree of acidic activity on the matrixed catalyst. The use of silica as a binder is preferred since alumina, even if non-acidic in character, may tend to react with the zeolite under hydrothermal reaction conditions to enhance its acidity. The zeolite is usually composited with the matrix in amounts from 80:20 to 20:80 by weight, typically from 80:20 to 50:50 zeolite:matrix. Compositing may be done by conventional means including mulling the materials together followed by extrusion or pelletizing into the desired finished catalyst particles. A preferred method for extruding the zeolite with silica as a binder is disclosed in U.S. Pat. No. 4,582,815. If the catalyst is to be steamed in order to achieve the desired low acidity, it is performed after the catalyst has been formulated with the binder, as is conventional.

The isomerization process isomerizes the long chain waxy paraffins in the raffinate to form iso-paraffins which are less waxy in nature but which possess a notably high viscosity index. At the same time, the acidic function of the zeolite will promote a certain degree of cracking or hydrocracking so that some conversion to products outside the lube boiling range will take place. This is not, however, totally undesirable, because any aromatics still present after the extraction step will tend to be removed by hydrocracking, with consequent improvements in the viscosity and VI of the product. The extent to which cracking reactions and isomerization reactions will predominate will depend on a number of factors, principally the nature of the zeolite, its inherent acidity, the severity of the reaction (temperature, contact time) and, of course, the composition of the feedstock. In general, cracking will be favored over isomerization at higher severities (higher temperature, longer contact time) and with more highly acidic forms of the zeolite. Thus, a higher zeolite silica:alumina ratio will generally favor isomerization and therefore will normally be preferred, except possibly to handle more aromatic or nitrogen-rich feeds. The acidity of the zeolite may also be controlled by exchange with alkali metal cations, especially monovalent cations such as sodium and divalent cations such as magnesium or calcium, in order to control the extent to which isomerization occurs relative to cracking. The extent to which isomerization will be favored over cracking will also depend upon the total conversion, itself a factor dependent upon severity. At high conversions, typically over about 80 volume percent, isomerization may decrease fairly rapidly at the expense of cracking; in general, therefore, the total conversion by all competing reactions should normally be kept below about 80 volume percent and usually below about 70 volume percent.

The relationships between cracking reactions and isomerization reactions for these zeolites are described in some greater detail in U.S. application Ser. No. 379,423 and its counterpart EP 94,826, to which reference is made for such a description.

The selection of the metal hydrogenation-dehydrogenation component will also have a bearing on the relative balance of reactions. The more highly active noble metals, especially platinum, promote hydrogenation-dehydrogenation reactions very readily and therefore tend to promote isomerization at the expense of cracking because paraffin isomerization by a mechanism involving dehydrogenation to olefinic intermediates followed by hydrogenation to the isomer products. The less active base metals, by contrast, will tend to favor hydrocracking and therefore may commend themselves when it is known that cracking reactions may be required to produce a product of the desired properties. Base metal combinations such as nickel-tungsten, cobalt-molybdenum or nickel-tungsten-molybdenum may be especially useful in these instances.

The hydroisomerization is carried out under conditions which promote the isomerization of the long chain, waxy paraffinic components to iso-paraffins to increase the V.I. of the product. Generally, the conditions may be described as being of elevated temperature and pressure. Temperatures are normally from 400 to 850° F. (204° C. to 454° C., preferably 600 to 800° F. (about 316 to 427° C.). Because the use of lower temperatures tends to favor the desired isomerization reactions over the cracking reactions, the lower temperatures will generally be preferred although it should be remembered that since the degree of cracking which will to some extent inevitably take place will be dependent upon severity, a balance may be established between reaction temperature and average residence time in order to achieve an adequate rate of isomerization while minimizing cracking. Pressures may range up to high values, e.g. up to 25,000 kPa (3,600 psig), more usually in the range 4,000 to 10,000 kPa (565 to 1,435 psig). The possibility of using low hydrogen pressures, e.g., below about 1000 psig (about 7000 kPa) is a particularly advantageous feature of the present process. Space velocity (LHSV) is generally in the range of 0.1 to 10 $hr.^{-1}$, more usually 0.2 to 5 $hr.^{-1}$, say, 0.5 to 1.5 $hr^{-1}$. The hydrogen:feed generally from 50 to 1,000 $n.l.l.^{-1}$ (about 280 to 5617 SCF/Bbl), preferably 200 to 400 $n.l\ l.^{-1}$ (about 1125 to 2250 SCF/Bbl). Net hydrogen consumption will depend upon the course of the reaction, increasing with increasing hydrocracking and decreasing as isomerization (which is hydrogen-balanced) predominates. The net hydrogen consumption will typically be under 90 $n.l.l.^{-1}$ (500 SCF/Bbl) and about 40 $n.l.l.^{-1}$ (about 224 SCF/Bbl) with the feeds of relatively low aromatic content such as the paraffinic neutral (distillate) feeds and slack wax and frequently will be less, typically below 35 $n.l.l.^{-1}$ (about 197 SCF/Bbl); with feeds which contain higher amounts of aromatics higher net hydrogen consumptions should be anticipated, typically in the range of 50–100 $n.l.l.^{-1}$ (about 280–560 SCF/Bbl), e.g. from 55–80 (about 310–450 SCF/Bbl). Process configuration will be as described in U.S. Pat. Nos. 4,419,220 and 4,518,485, i.e. with downflow trickle bed operation being preferred.

With highly paraffinic feeds of low aromatic content, it will be desirable to maximize isomerization over hydrocracking and therefore relatively low temperatures, e.g. from 250° to 400° C. (about 480° to 750° C.) will be preferred together with relatively low severities, e.g. space velocities (LHSV) of about 1 to 5, and catalysts of relatively low acidity. As a general guide, the bulk conversion to products outside the lube boiling range will be at least 10 weight percent and usually in the range 10 to 50 weight percent, depending upon the characteristics of the feed, the properties desired for the product and the desired product yield. With most feeds it will be found that there is an optimum conversion for VI efficiency, or yield efficiency, that is, for maximum VI relative to yield or maximum yield and in most cases, this will be in the range of 10–50 weight percent conversion, more commonly 15–40 weight percent conversion.

Selection of the severity of the hydroisomerization step is an important part of the present process because it is not possible to remove the straight chain and slightly branched chain waxy components in a completely selective manner, while retaining the desirable more highly branched chain components which contribute to high VI in the product. For this reason, the degree of dewaxing by isomerization which is achieved in the first step, is preferably limited so as to leave a residual quantity of waxy components which may then be removed in the subsequent dewaxing (catalytic or solvent) step. The objective of maximizing the isoparaffinic content of the effluent from the catalytic dewaxing step so as to obtain the highest VI in the final product may be achieved by adjusting the severity of the initial dewaxing operation until the optimum conditions are reached for this objective. Further details of the hydroisomerization are found in Ser. No. 793,937 and EP 225,053 to which reference is made for this purpose.

For upgrading a very waxy feedstock such a Minas VGO, the upstream furfural extraction and subsequent hydroisomerization with boron-containing zeolite beta isomerization catalyst results in high yields of a product of high viscosity index and adequate pour point without subsequent dewaxing and/or hydrofinishing. The use of low acidity zeolite beta results in a product of significantly higher viscosity index than a zeolite beta catalyst of higher acidity.

Although the product resulting from hydroisomerization can exhibit sufficiently low pour point and high viscosity index so that further processing is not required, subsequent dewaxing and hydrofinishing steps may be carried out as an option, depending on desired product specifications.

Dewaxing

Following the hydroisomerization the lube can be subjected to a dewaxing step which has two principal objectives. First, it will further reduce the pour point. Second, if a selective solvent dewaxing is used, a divergence between product pour point and cloud point can be avoided. Solvent dewaxing is therefore preferred for this step of the process and may be carried out according to conventional prescriptions for achieving the desired product pour point e.g. solvent/oil ratio, chill temperature etc. Conventional solvents such as methyl ethyl ketone (MEK)/toluene mixtures may be used or autorefrigerants such as propane. It is, however, possible to use highly selective solvents such as those having at least 80 vol % MEK, e.g., 100% MEK, in the present process because with the highly paraffinic streams produced by the use of waxy feeds, the phase separations observed with less highly paraffinic materials have not been found to occur. This phenomenon may be occasioned by the relative absence of aromatics coupled with the relatively high proportion of iso-paraffins. The use of such highly selective solvent dewaxing procedures is desirable because of the highly favorable separation of the waxy components, which it achieves while, at the same time, leaving the high V.I. iso-paraffins in the oil. However, less selective solvent mixtures may be used if desired, for example, MEK/toluene with 60 to 80 percent (v/v) MEK. The wax separated in the solvent dewaxing may be recycled to the initial isomerization step for further improvement in product quality and process efficiency. Catalytic dewaxing may also be employed at this stage of the process, for example, using an intermediate pore size dewaxing catalyst such as ZSM-5, ZSM-11, ZSM-23, or ZSM-35 in any of the catalytic dewaxing processes disclosed in the patents identified above, to which reference is made for a description of such processes. Catalytic dewaxing over zeolite ZSM-23 or ZSM-35 is especially preferred, particularly for light lube stocks e.g. up to 200 SUS light neutral because of the highly selective nature of the dewaxing with this zeolite. Dewaxing with ZSM-23 is described in U.S. Pat. No. 4,222,855 to which reference is made for a disclosure of the process. Catalytic dewaxing is preferred when extremely low pour point (<20° F.) lubricant products are desired.

Dewaxing at this stage is carried out to reduce the pour point to the desired value, typically below 10° F. (about −12° C.) and usually lower e.g. 5° F. (−15° C.). Dewaxing severity will be adjusted according to the desired pour point or other fluidity characteristic (cloud point, freeze point etc). Although increasing low pour points will result in lower yields as progressively more of the waxy paraffin content is removed in the processing. However, the iso-paraffinic character of the oil produced by the initial hydroisomerization step results in higher yields at higher VI levels than would otherwise be achieved.

Hydrofinishing

After dewaxing, the oil can hydrofinished to improve its lubricant quality by saturating residual lube boiling range olefins and removing color bodies and other sources of instability. If the hydrofinishing pressure is high enough, saturation of residual aromatics may also take place. Hydrofinishing conditions may be conventional for lube hydrofinishing, typically at 400°-700° F. (about 205°-370° C.), 400-5000 psig (about 2860-20,800 kPa), 0.1-5 LHSV, 500-10,000 SCF/Bbl $H_2$:oil (about 90-1780 n.l.l.$^{-1}$ $H_2$:oil). Catalysts typically comprise a metal hydrogenation component on an essentially non-acidic porous support such as alumina, silica or silica-alumina. The metal component is usually a base metal of Group VIA or VIIIA, or a combination of such metals, such as nickel, cobalt, molybdenum, cobalt-molybdenum or nickel-cobalt. Hydrofinishing catalysts of this type are conventional and readily available commercially. Hydrofinishing is particularly desirable after catalytic dewaxing by a shape-selective cracking process e.g. dewaxing over ZSM-5, because of the presence of lube range olefins in the dewaxed product which would otherwise lead to product instability.

The products of the present process are lubricants of high VI and low pour point and excellent oxidational stability, a combination of properties conferred by the presence of significant quantities of iso-paraffins coupled with relative freedom from aromatics. The use of the solvent extraction in combination with the subsequent isomerization dewaxing enables high VI to be coupled with low product pour point, as together with high efficiency in the process, either as to VI efficiency or yield efficiency.

EXAMPLES

The following examples are given in order to illustrate various aspects of the present process.

EXAMPLE 1

A premium quality lube base stock was prepared from a waxy Minas vacuum gas oil whose composition is set out in Table 1 below.

TABLE 1

| Minas Gas Oil | |
|---|---|
| Nominal boiling range, | 750°-1050° F. (399-566° C.) |
| API Gravity | 31.5 |
| Sulfur, wt % | 0.11 |
| Nitrogen, ppmw | 550 |
| Composition, wt % | |
| Paraffins | 52 |
| Naphthenes | 25 |
| Aromatics | 23 |

Minas 750°-1050° F. (399°-566° C.) boiling range VGO, having a pour point of +110° F. (43° C.) and containing about 52% wt. total paraffins (mainly n-paraffins), was treated in a continuous furfural extraction unit (7 stages, 200 vol %, 255° F. (124° C.)). Under these furfural extraction conditions, this feedstock yielded about 69 vol % Minas raffinate containing about 39.8 wt % entrained oil and very low heteroatom level (4 ppm N, 0.03 wt % S). The properties of the Minas raffinate resembled those of a typical Heavy Neutral slack wax feedstock (35 wt % oil, 59 ppm N, 0.12 wt % S).

Table 2 below sets out the product properties of Minas VGO feedstock after furfural extraction with those of a conventional Heavy Neutral slack wax feedstock.

TABLE 2

| | Minas Gas Oil | |
|---|---|---|
| | Raffinate | HN Slack Wax |
| Nominal boiling range, | 750–1050° F. | 650–1050° F. |
| API Gravity | 36.0 | 36.0 |
| Sulfur, wt % | 0.03 | 0.13 |
| Nitrogen, ppmw | 4 | 59 |
| Oil Content, wt % | 39 | 36 |
| Composition, wt % | | |
| Paraffins | 62 | 55 |
| Naphthenes | 32 | 26 |
| Aromatics | 6 | 19 |

A comparison of the Minas Gas Oil of Table 1 and its raffinate in Table 2 indicates that the furfural extraction step reduces significantly the heteroatom levels in the Minas VGO, concentrates the wax content and produces a Minas raffinate with product properties similar to those of a typical slack wax. This Minas raffinate has higher paraffin content and much lower aromatic content even when compared with a slack wax (62 v. 55 wt % paraffins and 6 vs. 19 wt % aromatics).

EXAMPLE 2 (Comparative)

The Minas raffinate obtained from Example 1 was processed over a Pt/zeolite beta catalyst. The catalyst was an extrudate comprised of 65 wt % zeolite beta, 35 wt % alumina binder. Prior to 0.6 wt % Pt addition, the extrudate was steamed to lower its acidity to about 55 alpha. Further properties of this catalyst as well as those of the Pt boron zeolite beta catalyst of Example 3 are set out below in Table 3.

TABLE 3

| | Catalyst Properties | |
|---|---|---|
| | Pt/Beta/$Al_2O_3$ | Pt/B Beta/$SiO_2$ |
| Beta, wt % | 65 | 65 |
| $Al_2O_3$, wt % | 35 | — |
| $SiO_2$, wt % | — | 35 |
| Density, g/cc Packed | 0.53 | 0.55 |
| Pt, wt % | 0.66 | 0.87 |
| Alpha (w/o Pt) | 55 | 4 |

The hydroisomerization evaluation was carried out in a fixed-bed unit under 400 psig, 1 LHSV, 2000 SCF/Bbl $H_2$ circulation and in the temperature range of 740°–770° F. (393°–410° C). Under these process conditions, the 650° F.+ boiling point conversion was in the range of 0–67 wt %. After vacuum distillation at 650° F. to remove converted products, certain portions of the 650° F.+ fraction were subjected to a conventional methyl ethyl ketone (MEK) dewaxing step to produce a lube fraction using 100% MEK at −25° F. (−32° C.) to obtain a +20° F. (−6° C.) pour point product in 28–56% yield.

Table 4 shows the relationship of 650° F.+ conversion with lube production from the waxy Minas raffinate. The results show that this waxy Minas raffinate provides about 51.1 wt % lube yield with a maximum 111 VI at 32.8 wt % 650° F.+conversion by upgrading over Pt zeolite beta/MEK dewaxing combination.

TABLE 4

Upgrading Minas Raffinate Feedstock Using The Combination Furfural Extraction/ Pt Zeolite Beta/MEK Dewaxing

| | Minas Raffinate | Pt Zeolite Beta | | | | | |
|---|---|---|---|---|---|---|---|
| R × R Temp. °F. | Feed | 740 | 745 | 750 | 758 | 761 | 770 |
| 650° F. + Conv., wt % | — | 22.4 | 32.8 | 38.3 | 48.9 | 53.5 | 67.7 |
| Overall MEK Lube Yield, wt % | 45.0 | 56.1 | 51.1 | 47.0 | 45.6 | 40.1 | 28.6 |
| Lube Properties | | | | | | | |
| Pour Point, °F. | +30 | +20 | +20 | +10 | +10 | +10 | 0 |
| KV @ | | | | | | | |
| 40° C., cSt | 49.51 | 35.13 | 32.27 | 31.89 | 31.50 | 32.65 | 35.82 |
| 100° C., cSt | 7.031 | 5.870 | 5.577 | 5.511 | 5.421 | 5.485 | 5.561 |
| VI | 98 | 109 | 111 | 109 | 107 | 103 | 89 |
| VI Corrected to 20° F. Pour Point | 96 | 109 | 111 | 111 | 109 | 105 | 93 |

EXAMPLE 3

A second portion of the Minas raffinate obtained from Example 1 was processed over a Pt boron-containing zeolite beta catalyst in place of the conventional zeolite beta as in Example 2. The catalyst was an extrudate comprised of 65 wt % zeolite beta, 35 wt % $SiO_2$ and contained 0.87 wt % Pt. Properties of the catalyst are set out in Table 3 above. The catalyst had very low acidity as indicated by a low alpha measurement of 5 (taken prior to Pt addition).

The hydroisomerization evaluation was carried out in a fixed-bed unit at 400 psig, 0.5–1.0 LHSV, 2000 SCF/Bbl $H_2$ circulation and in the temperature range of 765°–780° F. (407°–416° C.). Under these process conditions, with the 650° F.+ boiling point conversion at 27.3 wt %, the Pt boron zeolite beta produced directly a 20° F. (−6° C.) pour lube base stock without subsequent MEK dewaxing as shown in the Figure. Samples of the hydroisomerization product were subsequently treated by MEK dewaxing under the same conditions set out in Example 2. The combination with MEK dewaxing further increases the VI potential to at least 130 VI, as shown in Table 5 below, at very low conversion of 650° F.+product (10.1 wt %).

TABLE 5

Direct Upgrading Minas Raffinate over Pt Boron-Containing Zeolite Beta

| | Minas Raffinate | Pt Boron-Zeolite Beta | | | | |
|---|---|---|---|---|---|---|
| R × R Temp. °F. | — | 765 | 759 | 750 | 774 | 779 |

TABLE 5-continued

| Direct Upgrading Minas Raffinate over Pt Boron-Containing Zeolite Beta | | | | | | |
|---|---|---|---|---|---|---|
| | Minas Raffinate | Pt Boron-Zeolite Beta | | | | |
| LHSV, hr-1 | — | 1.0 | 1.0 | 06.4 | 1.0 | 1.0 |
| 650° F. + Conv., wt % | — | 21.2 | 23.1 | 27.3 | 27.5 | 45.6 |
| 650° F. + roperties | | | | | | |
| H, wt % | 14.85 | 14.49 | 14.46 | 14.51 | 14.32 | 14.53 |
| S, wt % | 0.030 | 0.010 | 0.005 | 0.002 | 0.005 | 0.002 |
| Pour Point, °F. | +110 | +50 | +40 | +20 | +35 | −15 |
| KV @ | | | | | | |
| 40° C., cSt | — | 21.68 | 20.34 | 25.00 | 24.12 | 24.19 |
| 100° C., cSt | 4.991 | 4.570 | 4.363 | 4.783 | 4.909 | 4.624 |
| VI | — | 128 | 125 | 120 | 122 | 107 |

Table 6 compares the performance of low acidity Pt boron zeolite beta with the higher acidity Pt/zeolite beta of Example 2. The results indicate that the low acidity Pt boron-containing zeolite beta not only increases the VI potential by at least 20 VI numbers from 111 to 130 VI, but also improves significantly the lube yield from 56.1 to 89.9 wt % as compared to the higher acidity Pt/zeolite beta. The higher paraffin content (64–66 wt %) in the lube produced from the Pt boron zeolite beta reflects its improved hydroisomerization selectivity.

TABLE 6

| The comparison of Pt Boron Zeolite Beta Versus Pt Zeolite Beta For Upgrading Minas Raffinate Feedstock | | | | | |
|---|---|---|---|---|---|
| | Pt Zeolite Beta | | Pt Boron Zeoite Beta | | |
| MEK Dewaxing | Yes | Yes | Yes | Yes | No |
| 650° F. + Conv., wt % | 22.4 | 32.8 | 10.1 | 16.1 | 27.3 |
| Overall Lube Yield, wt % | 56.1 | 51.1 | 89.9 | 75.6 | 72.7 |
| Lube Properties | | | | | |
| Pour Point, °F. | °20 | +20 | +20 | +15 | +20 |
| KV | | | | | |
| @ 40° C., cSt | 35.13 | 32.27 | 21.89 | 23.43 | 24.12 |
| @ 100° C., cSt | 5.870 | 5.577 | 4.621 | 4.776 | 4.783 |
| VI | 109 | 111 | 130 | 127 | 120 |
| Composition, wt % | | | | | |
| Paraffins | 49.2 | 47.5 | 65.2 | 64.8 | 65.3 |
| Mono-Napthenes | 12.0 | 11.5 | 7.2 | 7.3 | 5.5 |
| Poly-Napthenes | 26.2 | 28.3 | 17.2 | 15.1 | 16.8 |
| Aromatics | 12.6 | 12.7 | 10.3 | 12.8 | 12.4 |

We claim:

1. A process for producing a high viscosity index (VI) lubricant from a hydrocarbon feed of mineral oil content having a paraffin content of at least 30 wt %, an aromatics content of at least 10 wt %, and a nitrogen content of at least 50 ppm, and which comprises:
   i) extracting said feed with a solvent which is selective for aromatics to provide an extracted feed containing greater than 40 wt % paraffins, less than 15 wt % aromatics, and less than 30 ppm nitrogen content, and
   ii) hydroisomerizing the extracted feed with a low acidity zeolite beta catalyst having an alpha value less than 15 and an inorganic oxide matrix to provide a lubricant having a viscosity index of at least 110.

2. The process according to claim 1 in which the hydroisomerizing is carried out at a temperature from 400° to 850° F., a total pressure of at least 100 psig and a space velocity of 0.1 to 10 LHSV, and said catalyst has an alpha value of less than 10.

3. The process according to claim 1 in which the hydroisomerizing is carried out at a temperature from 600 to 800° F., a total pressure from 200 to 1000 psig and a space velocity of 0.5 to 1.5 LHSV, and said catalyst has an alpha value of less than about 5.

4. The process according to claim 2 in which the zeolite beta catalyst comprises noble metal on zeolite beta.

5. The process according to claim 4 in which said noble metal is selected from the group consisting of palladium and platinum.

6. The process according to claim 1 in which the zeolite beta catalyst comprises a silica matrix.

7. The process according to claim 1 in which the solvent selective for aromatics is selected from the group consisting of furfural, N-methyl-pyrrolidone, and phenol.

8. The process of claim 1 which further comprises:
   iii) solvent dewaxing the hydroisomerized lubricant to reduce its pour point.

9. The process according to claim 8 in which the dewaxing solvent comprises at least 80 vol. percent methyl ethyl ketone.

10. The process of claim 1 which further comprises:
   iii) catalytic dewaxing the hydroisomerized lubricant by paraffin cracking to reduce its pour point.

11. The process according to claim 1 in which the product lubricant has a VI of at least 110 and a pour point not higher than 20° F.

12. The process according to claim 1 in which the hydrocarbon feed is a neutral lubricant distillate.

13. A process for producing a high viscosity index (VI) lubricant from a hydrocarbon feed of mineral oil content having a paraffin content of at least 30 wt %, a nitrogen content of at least 50 ppm, and an aromatics content of at least 10 wt % which consists essentially of:
   i) extracting said feed with a solvent which is selective for aromatics to provide an extracted feed containing greater than 40 wt % paraffins, less than 15 wt % aromatics, and less than 30 ppm nitrogen content, and
   ii) hydroisomerizing the extracted feed with a low acidity zeolite beta catalyst containing zeolite beta comprising boron as a framework component and an inorganic oxide matrix to provide a lubricant having a viscosity index of at least 110.

14. The process according to claim 13 in which the hydroisomerizing is carried out at a temperature from 400 to 850° F., a pressure from 200 to 1500 psig and a space velocity of 0.1 to 10 LHSV, and said zeolite beta catalyst comprises platinum on zeolite beta and said catalyst has an alpha value of less than 10.

15. The process according to claim 13 in which the solvent selective for aromatics is selected from the group consisting of furfural, N-methyl-pyrrolidone, and phenol.

16. The process according to claim 13 in which the lubricant is produced with a hydrogen consumption of not more than 500 SCF/Bbl in step (ii) of the process.

17. The process according to claim 13 in which the zeolite beta catalyst comprises platinum on zeolite beta.

18. The process according to claim 13 in which the zeolite beta catalyst comprises palladium on zeolite beta.

19. The process according to claim 13 in which the zeolite beta catalyst comprises a silica matrix.

20. The process according to claim 13 in which the hydrocarbon feed is a neutral lubricant distillate.

* * * * *

UNITED STATES PATENT AND TRADEMARK OFFICE

CERTIFICATE OF CORRECTION

PATENT NO. : 5,302,279

DATED : April 12, 1994

INVENTOR(S) : Thomas F. Degnan et al

It is certified that error appears in the above-indentified patent and that said Letters Patent is hereby corrected as shown below:

Col. 15, line 67, Claim 3 should be renumbered Claim 5.

Col. 16, line 35 claim 9 should be renumbered claim 10.

Col. 16, line 38, claim 10 should be renumbered claim 9.

Signed and Sealed this

Sixteenth Day of August, 1994

*Attest:*

Bruce Lehman

BRUCE LEHMAN

*Attesting Officer*

*Commissioner of Patents and Trademarks*